US010513875B2

(12) United States Patent
Balay et al.

(10) Patent No.: US 10,513,875 B2
(45) Date of Patent: Dec. 24, 2019

(54) FLOATING TORSION SPRING TENSION ADJUSTMENT SYSTEM

(71) Applicant: CIW Enterprises, Inc., Mountaintop, PA (US)

(72) Inventors: Joseph L. Balay, Sugarloaf, PA (US); Thomas Balay, Drums, PA (US)

(73) Assignee: CornellCookson, LLC, Mountaintop, PA (US)

( * ) Notice: Subject to any disclaimer, the term of this patent is extended or adjusted under 35 U.S.C. 154(b) by 169 days.

(21) Appl. No.: 15/673,072

(22) Filed: Aug. 9, 2017

(65) Prior Publication Data

US 2019/0048636 A1 Feb. 14, 2019

(51) Int. Cl.
*E05D 13/00* (2006.01)

(52) U.S. Cl.
CPC .... *E05D 13/1261* (2013.01); *E05Y 2201/492* (2013.01); *E05Y 2900/132* (2013.01)

(58) Field of Classification Search
CPC . E05D 13/1253; E05D 13/12; E05D 13/1207; E05D 13/1215; E06B 9/62; E06B 6/62; E06B 9/322
USPC ..... 160/189, 190, 191, 314; 267/166, 167, 267/175, 178; 242/375.1, 375.2, 375.3; 49/200
See application file for complete search history.

(56) References Cited

U.S. PATENT DOCUMENTS

| | | | | |
|---|---|---|---|---|
| 2,789,231 | A * | 4/1957 | Robinson | A61B 6/02 318/692 |
| 5,419,010 | A * | 5/1995 | Mullet | E05D 13/1261 16/198 |
| 6,408,925 | B1 * | 6/2002 | Dorma | E05D 13/1261 160/191 |
| 6,926,061 | B2 * | 8/2005 | Schulte | E05D 13/1215 160/191 |
| 7,967,051 | B2 * | 6/2011 | Diaz | E05D 13/1261 160/188 |
| 8,162,026 | B1 * | 4/2012 | Lundahl | E05D 13/1261 160/189 |
| 2003/0213566 | A1 | 11/2003 | Lewis, Jr. et al. | |
| 2007/0204515 | A1 | 9/2007 | Barriault | |
| 2011/0047877 | A1 | 3/2011 | Hellinga | |
| 2015/0020456 | A1 | 1/2015 | Nykilchuk | |

FOREIGN PATENT DOCUMENTS

| | | |
|---|---|---|
| JP | 2015148113 | 8/2015 |

* cited by examiner

*Primary Examiner* — Katherine W Mitchell
*Assistant Examiner* — Jeremy C Ramsey
(74) *Attorney, Agent, or Firm* — Mitchell A. Smolow

(57) ABSTRACT

An overhead door having a floating spring adjustment is presented. Tension is applied to a torsion spring while the door is in the open, minimal tension state. One end of the torsion spring is fixed to a spring tension trolley. The trolley translates within a trolley guide mounted to the building structure. The other end of the torsion spring is fixed to a shaft running through the torsion spring. This allows the torsion spring to change in length as the number of coils shrink and grow through door operation thereby eliminating the "snake-like" or serpentine appearance from an improper fixed torsion spring length.

15 Claims, 5 Drawing Sheets

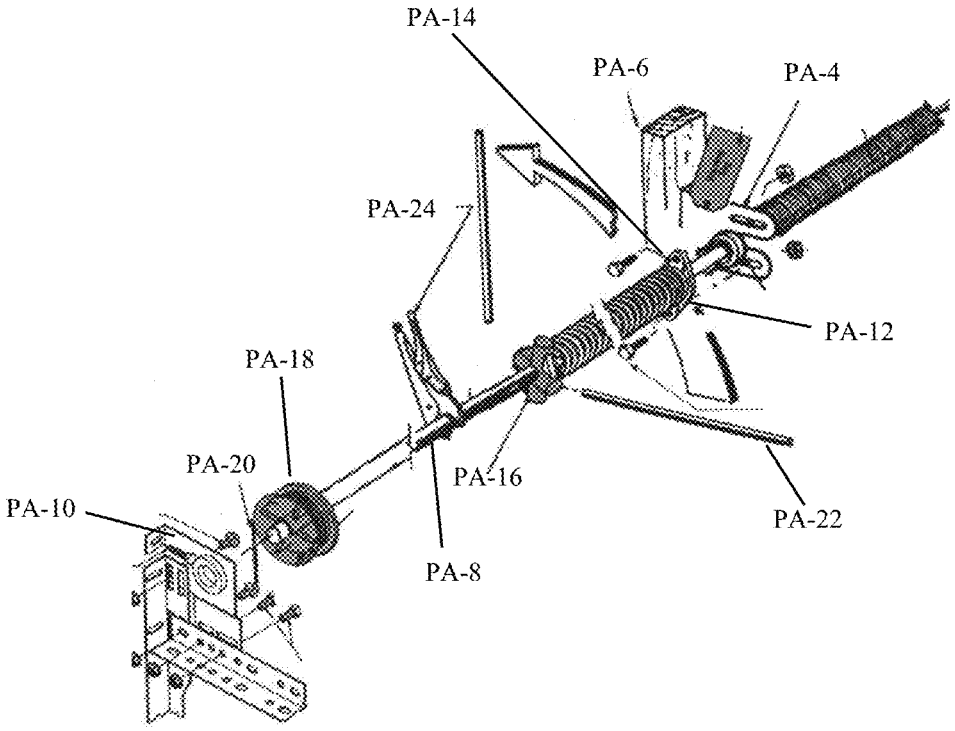
FIG. PA-1
PRIOR ART

FLOATING TORSION SPRING TENSION ADJUSTMENT SYSTEM

FIELD OF THE INVENTION

This invention relates generally to overhead doors, and in particular, to an overhead door torsion spring tension adjustment system.

BACKGROUND OF THE INVENTION

Overhead doors such as rolling metal doors and metal and fabric curtains are commonly counterbalanced by torsion spring assemblies which include a support shaft which extends through the torsion spring. Conventionally, the support shaft is anchored at one end to a non-movable support mounted to the building structure to which one end of the spring is also mounted. The opposite end of the support shaft is mounted to a second non-movable support also mounted to the building structure.

The opposite end of the torsion spring is anchored, for example, by a cup-like socket or retainer often referred to as a winding cone, which is retentively secured at a fixed support shaft location. The winding cone is used as an adjuster for varying the tension of the torsion spring. With the door in a closed position selected tension is imparted to the spring. This tension is transmitted by, for example, cables connecting the shaft to the door, to counterbalance or compensate for the weight of the door.

Typically, a torsion spring is fabricated with no gaps or spaces between its coils when the spring is in a free or untensioned state. As turns are applied to a spring the number of active coils increases. As the number of active coils increases the length of the spring also increases. In assembling the torsion spring assembly on a door the ends of the spring are securely connected to the anchors while simultaneously stretching the spring to space its coils apart. Coil spacing is required to allow space for additional coils to be formed later as the spring is twisted to perform its counterbalancing function.

As spring tension is applied during door operation the physical properties of the spring material may be adversely affected, thereby increasing the risks of premature spring breakage. "Snake-like" or serpentine appearance of the tensioned spring from improper pre-stretch or tensioning is particularly problematic in causing premature torsion spring failure.

Accordingly, there is still a continuing need for improved overhead door torsion spring tension system designs. The present invention fulfills this need and further provides related advantages.

BRIEF SUMMARY OF THE INVENTION

The overhead door floating torsion spring tension adjustment described in detail below allows for the use of a longer, full length torsion spring for higher cycle life. This eliminates some of the components used to split a conventional torsion spring into two sides, including bending hooks on either end and castings for attachment and adjustment. Although they are not required, they can be used.

Unlike conventional designs, tension is applied to the torsion spring while the door is in the open, minimal tension state. One end of the torsion spring is translationally fixed to a spring tension trolley. The spring tension trolley translates within a spring trolley guide mounted to the building structure. This allows the torsion spring to change in length as the number of coils shrink and grow through door operation, thereby eliminating the "snake-like" or serpentine appearance from an improper fixed torsion spring length. While it can also be used as in conventional applications, it gives the option of only tensioning to the minimum or open door torque requirement.

Other features and advantages of the present invention will be apparent from the following more detailed description of the preferred embodiments taken in conjunction with the accompanying drawings which illustrate by way of example the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

FIG. PA-1 is a perspective exploded view of a conventional split torsion spring design.

DETAILED DESCRIPTION OF THE INVENTION

Figure 1:
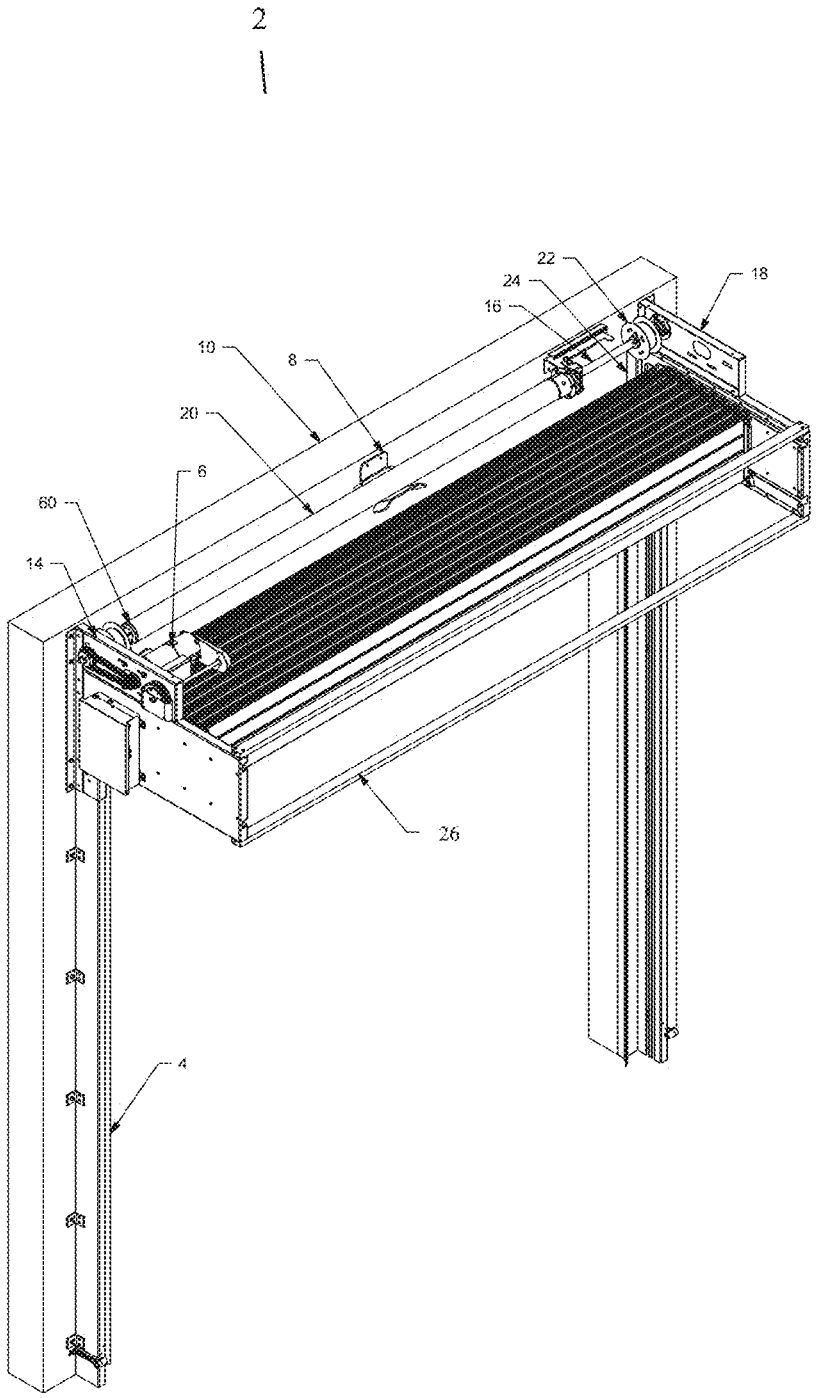
FIG. 1 is a perspective view of an overhead door and torsion spring tension adjustment system.

As required, detailed embodiments of the present invention are disclosed; however, it is to be understood that the disclosed embodiments are merely exemplary of the invention that may be embodied in various forms. The figures are not necessarily to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

As used herein, torsion spring length means the distance measured along the spring assembly shaft from the torsion spring first end to the torsion spring second end.

Turning now to FIG. PA-1, conventionally, a center bearing plate PA-4 is mounted to a wood anchor pad PA-6 which is fixed to the building structure (not shown). The center bearing plate PA-4 supports the middle of a support shaft PA-8, the first and second (not shown) end are supported by an end bearing plate PA-10. The support shaft PA-8 passes through a winding spring PA-12.

The winding spring PA-12 is fixed at a first end to a spring anchor PA-14 which is immovably attached to the center bearing plate PA-4. The second end of the winding spring PA-12 is fixed to a winding cone PA-16 which is rotatably attached to the support shaft PA-8.

A cable drum PA-18 is fixed to the support shaft PA-18 to windingly receive a cable PA-20 which is fixed to a door (not shown). To torque the winding spring PA-12, the support shaft PA-8 is prevented from rotating, usually by applying a locking pliers PA-24 to the support shaft PA-8 which in turn is prevented from rotating as it encounters the door header (not shown). A pair of winding bars PA-22 are used to turn the winding cone PA-16 thereby applying the maximum torque required to the winding spring PA-12 while the door is in the closed position. This places the person applying torque to the spring in a dangerous and difficult position as they are working with the spring in a maximum torque state.

When the proper tension is achieved, the winding cone PA-16 is non-rotatingly fixed to the support shaft PA-8, usually by friction bolts (not shown) and the locking pliers PA-24 are removed. The full weight of the door transmitted through the cable PA-20 prevents the support shaft PA-8 from turning, thereby maintaining spring tension.

Because both ends of the winding spring PA-12 are fixed and non-movable, the spring length also remains constant as the spring winds and unwinds as the door is opened and closed. In many cases the installer will have to return to the job site to remove the torque from the spring and re-torque while stretching the spring properly to remove the unsightly serpentine affect caused by either allowing too little or too much room for the spring to grow in length.

Unlike conventional designs, the novel structure described below permits the spring length to vary as the spring winds (tensions) and unwinds (de-tensions).

Turning now to FIG. 1, an overhead door 2 is depicted. The door 2 comprises a pair of door guides 4, one guide 4 fixed to the structure at opposite sides of the door 2 to operatively receive a door closure 26. An optional operator, for example, a motor or chain assembly, is operatively attached to the door closure 26 to open and close the door closure 26.

A spring support bracket 8 is fixed to the building structure 10 and supports a torsion spring 20. A first bracket 14 supports a first end of a spring assembly shaft 16, the second end is supported by a second bracket 18. The spring assembly shaft 16 passes through the torsion spring 20. To avoid clutter and to aid in figure clarity, the torsion spring 20 is drawn as a solid pipe.

Figure 4:
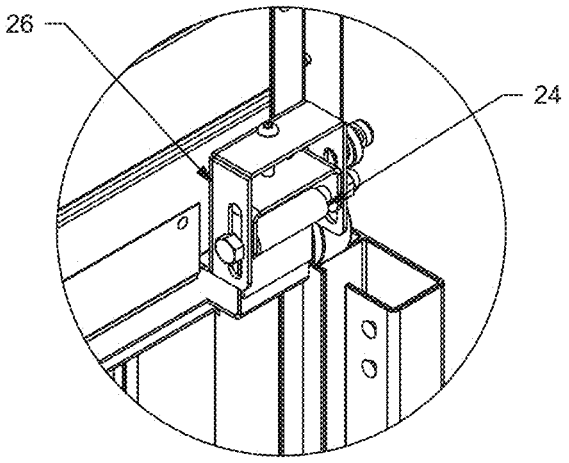
FIG. 4 is a perspective view of the strap attachment.

A door lifting assembly, for example, a strap spool 22 is fixed to the spring assembly shaft 16 at each end to windingly receive a respective strap 24 which is respectively fixed to the door closure 26, depicted in greater detail in FIG. 4. The weight of the door closure 26 transmitted through the strap 24 maintains spring tension, described in detail below.

Figure 2:
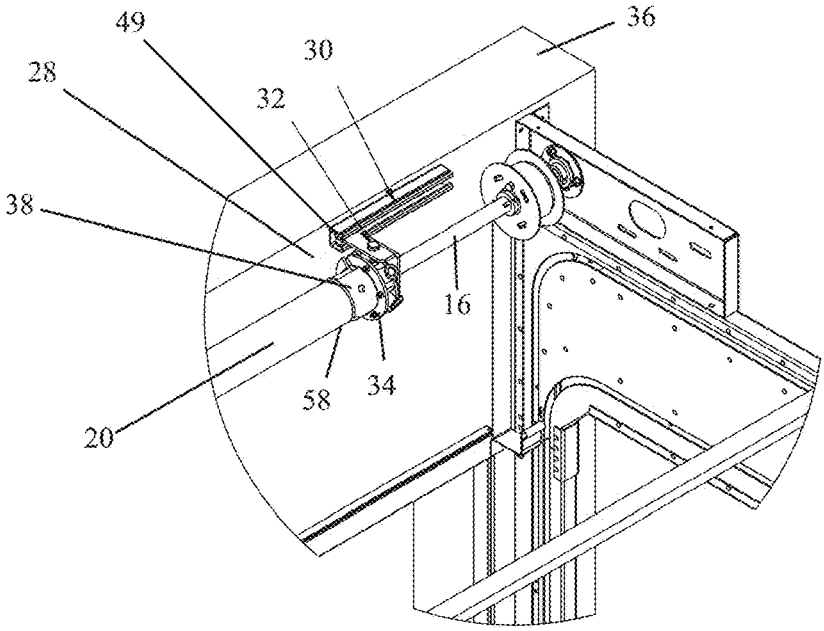
FIG. 2 is a perspective view of a spring adjustment assembly first embodiment.
Figure 3:
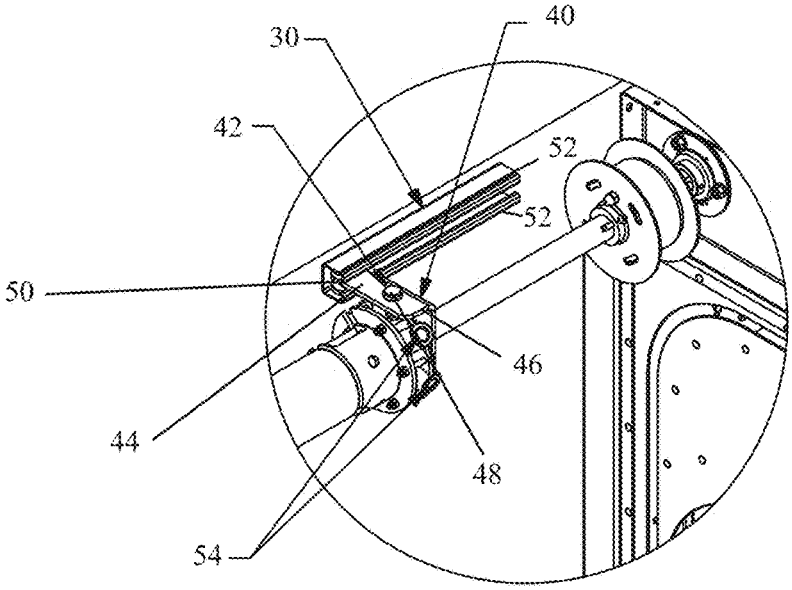
FIG. 3 is another perspective view of the spring adjustment assembly first embodiment.
Figure 5:
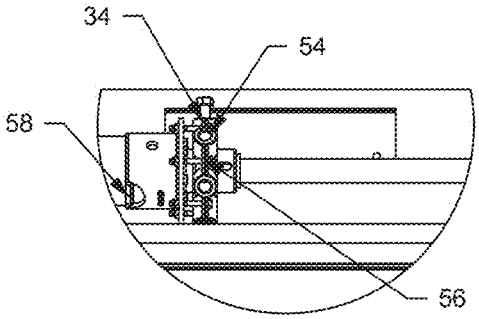
FIG. 5 is a top view of a spring adjustment assembly.

In a first spring tension adjustment assembly embodiment, depicted in FIGS. 2, 3 and 5, a spring trolley assembly 28 maintains spring tension. The spring trolley assembly 28 comprises a spring tension trolley guide 30, a spring tension trolley 32, and a spring tension casting 34.

The spring tension trolley guide 30 is non-movably positioned, for example, fixed to the door header 36, and translationally receives the spring tension trolley 32. The spring tension trolley 32 comprises a first section 38 having an orifice through which the spring assembly shaft 16 passes, and a second section 40 having a spring tension casting retainer 42 and a trolley guide engagement member 44.

In a preferred form, the spring tension casting retainer 42 comprises an engagement section, for example, orifice 46 to restrictively engage a casting retaining member 48 which restrictively engages the spring tension casting 34 when in the retainment position. The trolley guide engagement member 44 comprises, for example, guide retaining member 49 which slidingly restrictively engages the spring tension trolley guide 30. In this preferred form the spring tension trolley guide 30 is generally U shaped in cross section and has two opposing longitudinal retaining edges 52 to retainingly engage the guide retaining member 49. Guide retaining member 49 comprises a guide engagement member 50, for example wheels.

In this manner the wheels 50 rotatingly translate within the spring tension trolley guide 30 as the trolley guide engagement member 44 translates along the spring assembly shaft 16.

The spring tension casting 34 is fixed to a first end 58 of the torsion spring 20 and like the torsion spring 20 has the spring assembly shaft 16 passing through it. An optional bearing inside the spring tension casting 34 allows the spring tension casting 34 to more easily translate on the spring assembly shaft 16. A casting tensioner 54, preferably a plurality of casting tensioners 54 circumferentially placed on spring tension casting first section 56, engage the trolley guide engagement member 44 and once engaged prevent rotation of the spring tension casting 34 and the torsion spring first end 58.

The second end 60 (FIG. 1) of the torsion spring 20 is fixed in a non-movable position to the spring assembly shaft 16. To apply tension to the torsion spring 20 the spring tension casting 34 is rotated, for example, by inserting tensioning rods (not shown) into sequential casting tensioners 54 and rotating until desired tension is achieved. Once desired tension is achieved, the trolley guide engagement member 44 is engaged with the spring tension casting 34 to prevent rotation of the spring trolley casting 34 and therefore, unwinding of the attached torsion spring 20.

In this manner, as the torsion spring 20 winds and unwinds with the closing and opening of the door closure 26 the spring tension casting 34 is free to translate along the spring assembly shaft 16 allowing the torsion spring 20 to increase and decrease in length. The amount of change in torsion spring length is limited only by the size of the spring tension trolley guide 30. Optional stops may be added on the trolley guide to prevent disengagement, however, they are not required because the trolley guide is fabricated to be longer than the length at which disengagement would occur.

Figure 6:
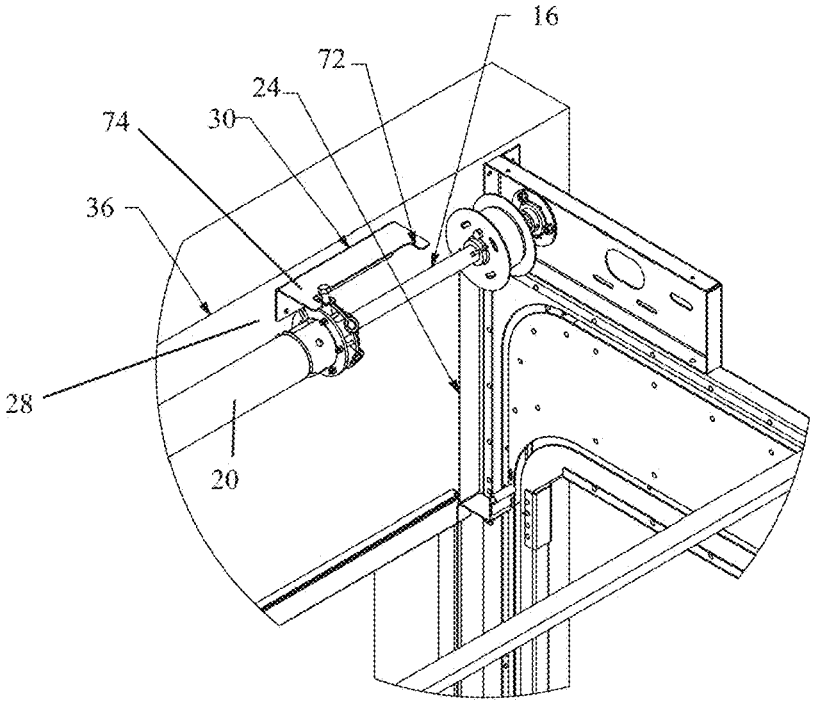
FIG. 6 a perspective view of a spring adjustment assembly second embodiment.
Figure 7:
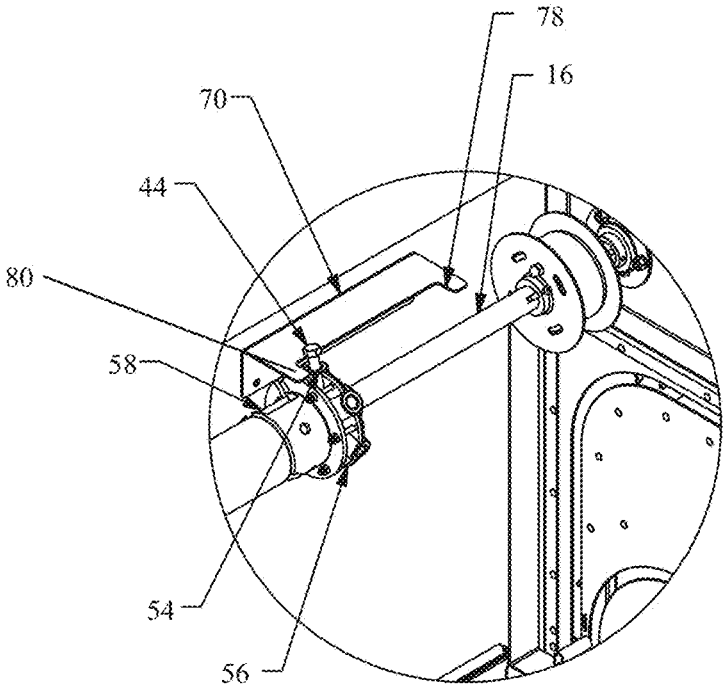
FIG. 7 is another view of the spring adjustment assembly second embodiment.

In a second spring tension adjustment assembly embodiment, depicted in FIGS. 5, 6 and 7, the spring trolley guide is replaced with a hood 70 that is non-movably positioned, for example, mounted to the door header 36. The hood 70 comprises a first 72 and second 74 stop at respective hood ends.

The spring tension casting 34 is fixed to the first end 58 of the torsion spring 20 and like the torsion spring 20 has the spring assembly shaft 16 passing through it. To avoid clutter and to aid in figure clarity, the torsion spring 20 is drawn as solid. As in the first embodiment, an optional bearing inside the spring tension casting 34 allows the spring tension casting 34 to more easily translate on the spring assembly shaft 16 as necessary.

A casting tensioner 54, preferably a plurality of casting tensioners 54 circumferentially placed on spring tension casting first section 56, receive a hood engagement member 44 and once engaged with the hood 70 prevents unwinding of the spring tension casting 34 and the torsion spring first end 58.

The second end 60 of the torsion spring 20 is fixed in a non-movable position to the spring assembly shaft 16. In this embodiment, as in the first embodiment, to apply tension to the torsion spring 20, the spring tension casting 34 is rotated, for example, by inserting tensioning rods into sequential casting tensioners 54 and rotating until desired tension is achieved.

Once desired tension is achieved the hood the engagement member 44 is engaged with the hood 70 to prevent unwinding of the spring trolley casting 34 and therefore, unwinding of the attached torsion spring 20. If desired, the tensioning rod may be left in a casting tensioner 54 to serve as the hood engagement member 44.

In this manner, as the torsion spring 20 winds and unwinds with the closing and opening of the door closure 26 the spring tension casting 34 is free to translate along the spring assembly shaft 16 allowing the torsion spring 20 to increase and decrease in length. The amount of spring tension casting 34 translation is limited by the hood first 72 and second 74 stop (FIG. 6).

For example, the first 72 and second 74 stop comprise a respective first 78 and second 80 tab that translationally restrictively engages the hood engagement member 44 (FIG. 7). In this embodiment the amount of change in torsion spring length is limited only by the size of the hood 70.

In both embodiments, as spring tension is applied during door operation the torsion spring 20 is able to change in length so that the properties of the spring material are not adversely affected, thereby minimizing the risks of premature torsion spring 20 breakage. In particular, "snake-like" or serpentine appearance of the tensioned spring 20 is prevented.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A floating torsion spring tension adjustment system comprising:

a spring trolley assembly comprising a non-movably positioned spring tension trolley guide; a spring tension trolley; and a spring tension casting;

a spring tension casting retainer comprising an engagement section restrictively engaging a casting retaining member which engages the spring tension casting;

a torsion spring; and a spring assembly shaft passing through the spring tension casting and the torsion spring;

wherein;

the spring tension trolley guide translationally receives the spring tension trolley;

the spring tension trolley and spring tension casting translate on the spring assembly shaft;

the spring tension casting is fixed to a first end of the torsion spring;

the spring tension casting retainer when engaged with the spring tension casting prevents rotation of the spring tension casting; and a second end of the torsion spring is fixed in a non-movable position to the spring assembly shaft.

2. The system of claim 1 wherein the spring tension trolley comprises a first section having an orifice through which the spring assembly shaft passes, and a second section having the spring tension casting retainer and a trolley guide engagement member.

3. The system of claim 2 wherein the spring tension casting retainer engagement section comprises an orifice to restrictively engage the casting retaining member which restrictively engages the spring tension casting when in a retainment position.

4. The system of claim 2 wherein the trolley guide engagement member comprises a guide retaining member to restrictively engage the spring tension trolley guide.

5. The system of claim 4 wherein the guide retaining member comprises a guide engagement member restrictively engaging spring tension trolley guide first and second opposing longitudinal retaining edges.

6. The system of claim 5 wherein the guide engagement member is a wheel.

7. The system of claim 2 further comprising a plurality of casting tensioners circumferentially placed on a spring tension casting first section.

8. An overhead door comprising:

a pair of door guide operatively receiving a door closure;

a spring support bracket supporting a torsion spring, the torsion spring operatively connected to the door;

a first and second bracket supporting a spring assembly shaft;

a door lifting assembly operatively connected to the spring assembly shaft; and a spring tension adjustment assembly operatively connected to the torsion spring allowing a change in torsion spring length as the torsion spring is tensioned and de-tensioned;

wherein the spring tension adjustment assembly comprises:

a spring trolley assembly comprising a non-movably positioned spring tension trolley guide; a spring tension trolley; and a spring tension casting;

a spring tension casting retainer comprising an engagement section restrictively engaging a casting retaining member which engages the spring tension casting, the torsion spring and a spring assembly shaft passing through the spring tension casting and the torsion spring, wherein;

the spring tension trolley guide translationally receives the spring tension trolley;

the spring tension trolley and spring tension casting translate on the spring assembly shaft;

the spring tension casting is fixed to a first end of the torsion spring;

the spring tension casting retainer when engaged with the spring tension casting prevents rotation of the spring tension casting; and a second end of the torsion spring is fixed in a non-movable position to the spring assembly shaft.

9. The overhead door of claim 8 wherein the spring tension trolley comprises a first section having an orifice through which the spring assembly shaft passes, and a second section having the spring tension casting retainer and a trolley guide engagement member.

10. The overhead door of claim 9 wherein the spring tension casting retainer engagement section comprises an orifice to restrictively engage the casting retaining member which restrictively engages the spring tension casting when in a retainment position.

11. The overhead door of claim 9 wherein the trolley guide engagement member comprises a guide retaining member to restrictively engage the spring tension trolley guide.

12. The overhead door of claim 11 wherein the guide retaining member comprises a guide engagement member restrictively engaging spring tension trolley guide first and second opposing longitudinal retaining edges.

13. The overhead door of claim 12 wherein the guide engagement member is a wheel.

14. The overhead door of claim 9 further comprising a plurality of casting tensioners circumferentially placed on a spring tension casting first section.

15. A method of floating torsion spring tension adjustment comprising the steps of:

a. operatively connecting a torsion spring to an overhead door;

b. operatively connecting a spring tension adjustment assembly to the torsion spring;

c. allowing the torsion spring to change in length as it is tensioned and de-tensioned;

wherein the spring tension adjustment assembly comprises:

a spring trolley assembly comprising a non-movably positioned spring tension trolley guide; a spring tension trolley; and a spring tension casting;

a spring tension casting retainer comprising an engagement section restrictively engaging a casting retaining member which engages the spring tension casting, the torsion spring and a spring assembly shaft passing through the spring tension casting and the torsion spring, wherein;

the spring tension trolley guide translationally receives the spring tension trolley;

the spring tension trolley and spring tension casting translate on the spring assembly shaft;

the spring tension casting is fixed to a first end of the torsion spring;

the spring tension casting retainer when engaged with the spring tension casting prevents rotation of the spring tension casting; and a second end of the torsion spring is fixed in a non-movable position to the spring assembly shaft.

* * * * *